US009752423B2

(12) United States Patent
Lynk

(10) Patent No.: US 9,752,423 B2
(45) Date of Patent: Sep. 5, 2017

(54) METHOD OF REDUCING IMPACT OF DIFFERENTIAL BREAKDOWN STRESS IN A TREATED INTERVAL

(71) Applicant: BAKER HUGHES INCORPORATED, Houston, TX (US)

(72) Inventor: John M. Lynk, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 21 days.

(21) Appl. No.: 14/939,853

(22) Filed: Nov. 12, 2015

(65) Prior Publication Data

US 2017/0138162 A1 May 18, 2017

(51) Int. Cl.

| | |
|---|---|
| ***E21B 43/116*** | (2006.01) |
| ***E21B 43/26*** | (2006.01) |
| ***E21B 43/11*** | (2006.01) |
| ***E21B 33/12*** | (2006.01) |
| ***E21B 34/06*** | (2006.01) |
| ***E21B 43/14*** | (2006.01) |
| ***E21B 47/10*** | (2012.01) |
| ***E21B 37/06*** | (2006.01) |
| ***E21B 43/24*** | (2006.01) |
| ***E21B 43/20*** | (2006.01) |
| ***E21B 33/138*** | (2006.01) |

(52) U.S. Cl.

CPC ..... *E21B 43/261* (2013.01); *E21B 33/12* (2013.01); *E21B 33/138* (2013.01); *E21B 34/063* (2013.01); *E21B 37/06* (2013.01); *E21B 43/11* (2013.01); *E21B 43/14* (2013.01); *E21B 43/20* (2013.01); *E21B 43/24* (2013.01); *E21B 43/26* (2013.01); *E21B 47/1015* (2013.01)

(58) Field of Classification Search

CPC ..... E21B 23/14; E21B 33/124; E21B 43/26; E21B 43/14; E21B 43/116

See application file for complete search history.

(56) References Cited

U.S. PATENT DOCUMENTS

| | | | | |
|---|---|---|---|---|
| 5,425,424 | A | 6/1995 | Reinhardt et al. | |
| 5,704,426 | A * | 1/1998 | Rytlewski | E21B 23/00 166/297 |

(Continued)

FOREIGN PATENT DOCUMENTS

| | | | |
|---|---|---|---|
| CA | 2824767 | A1 | 8/2012 |
| CA | 2809946 | A1 | 5/2013 |
| WO | 2014035420 | A1 | 3/2014 |

*Primary Examiner* — Catherine Loikith

(74) *Attorney, Agent, or Firm* — Steve Rosenblatt

(57) ABSTRACT

A uniform interval treatment method features a plug with a breakable member in a passage set above a perforated interval so that pressure above the plug can be build up to the desired pressure that is high enough when the rupture disc breaks to deliver a burst of pressure at a level to overcome differential breakdown stress in the interval. A ball is then dropped on a seat on the same plug and captured so that it will stay on the seat when a gun is removed above. Another gun with a plug are delivered and the gun fired with the previous plug having a landed ball in the seat. The plug is again positioned above the just made perforations and the gun is removed. The rupture disc breaks to uniformly treat the next interval with a pressure to overcome differential breakdown stress of heterogeneous rock in the treated interval.

17 Claims, 8 Drawing Sheets

(56) References Cited

U.S. PATENT DOCUMENTS

| | | | | |
|---|---|---|---|---|
| 6,186,230 | B1 * | 2/2001 | Nierode | E21B 43/006 166/250.1 |
| 8,393,392 | B2 | 3/2013 | Mytopher et al. | |
| 2014/0102709 | A1 * | 4/2014 | Arabskyy | E21B 43/26 166/308.1 |
| 2015/0129218 | A1 | 5/2015 | Wright et al. | |

* cited by examiner

METHOD OF REDUCING IMPACT OF DIFFERENTIAL BREAKDOWN STRESS IN A TREATED INTERVAL

FIELD OF THE INVENTION

The field of the invention is fracture formation after perforation and more particularly methods for reduction of the impact of differential breakdown stress in an interval of perforations to be treated.

BACKGROUND OF THE INVENTION

One well known technique of fracturing is called "plug and perforate". In this technique a procedure is repeated in a down-well to up-well direction. The initial perforations are made in the borehole with a perforating gun and those perforations are treated. Thereafter a plug and gun are run in and the plug is set to isolate the already treated perforations. The gun is released and repositioned before being fired and removed from the borehole. Treatment fluid is pumped to initiate fractures in the second interval. This process may be repeated multiple times. After that the plugs are left in place, milled out, allowed to disintegrate, or otherwise modified to permit production through a production casing.

The problem is that each perforated interval has rock formations than can have differential breakdown stress. Under the traditional technique of pumping into the interval after perforating the interval, the entire interval may not be uniformly treated as the weaker rock formations will preferentially admit more flow than the stronger formations in the same interval. Thus, the portion of the interval with the stronger formations will be under-fractured due to the pumped flow taking a path of less resistance through the more easily fractured rock.

The method of the present invention addresses this issue with a plug design that has an integral passage that is initially obstructed with a rupture disc set to break at a predetermined high pressure that is high enough to fracture even the rock with the highest breakdown stress in the interval. The breaking of the breakable member or rupture disc ensures the spike of delivered pressure is high enough to initiate fractures at every cluster in the stage interval. The plug has a ball seat to accept a ball to isolate the just treated interval, and in some executions with a feature that retains the ball to the seat against the potential effect of swabbing out when the gun fired above it is pulled out of the hole. The process repeats in each interval before the plugs are removed. These and other aspects of the present invention will be more readily apparent to those skilled in the art from a review of the detailed description of the preferred embodiment and the associated drawings while recognizing that the full scope of the invention is to be determined from the appended claims.

Devices that use rupture discs for access to devices or the formation itself are described in U.S. Pat. No. 8,393,392; U.S. 2015/0129218 and WO/2014/035420. U.S. Pat. No. 5,425,424 illustrates the use of multiple rupture discs associated with multiple telescoping assemblies as well as pressure regulation devices with a goal of ensuring that all the telescoping assemblies extend as a way of producing a formation without perforation.

SUMMARY OF THE INVENTION

A uniform interval treatment method features a plug with a breakable member in a passage set above a perforated interval so that pressure above the plug can be build up to the desired pressure that is high enough when the rupture disc breaks to deliver a burst of pressure at a level to overcome differential breakdown stress in the interval. A ball is then dropped on a seat on the same plug and captured so that it will stay on the seat when a gun is removed above. Another gun with a plug are delivered and the gun fired with the previous plug having a landed ball in the seat. The plug is again positioned above the just made perforations and the gun is removed. The rupture disc breaks to uniformly treat the next interval with a pressure to overcome differential breakdown stress of heterogeneous rock in the treated interval.

DETAILED DESCRIPTION OF THE PREFERRED EMBODIMENT

Figure 1:
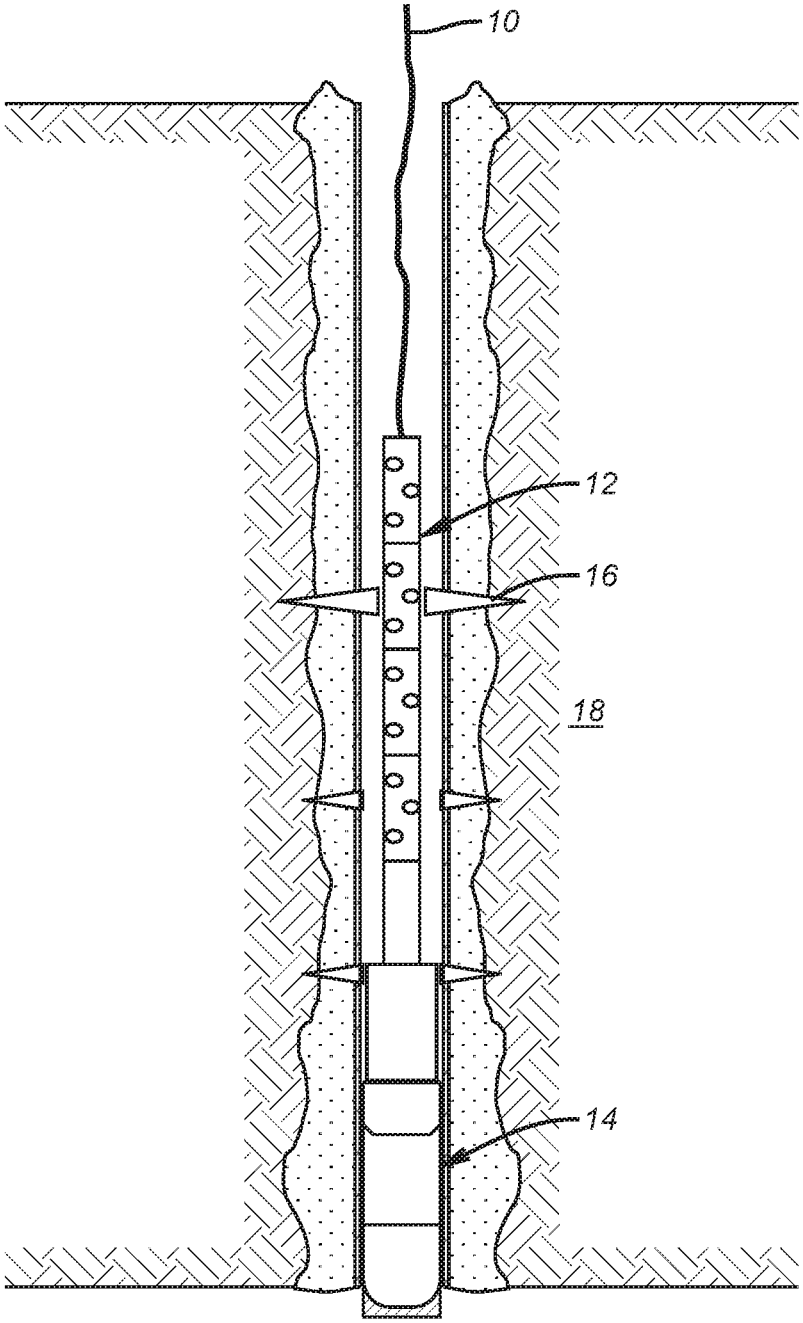
FIG. 1 schematically illustrates delivery of the first plug and gun and firing of the gun.
Figure 2:
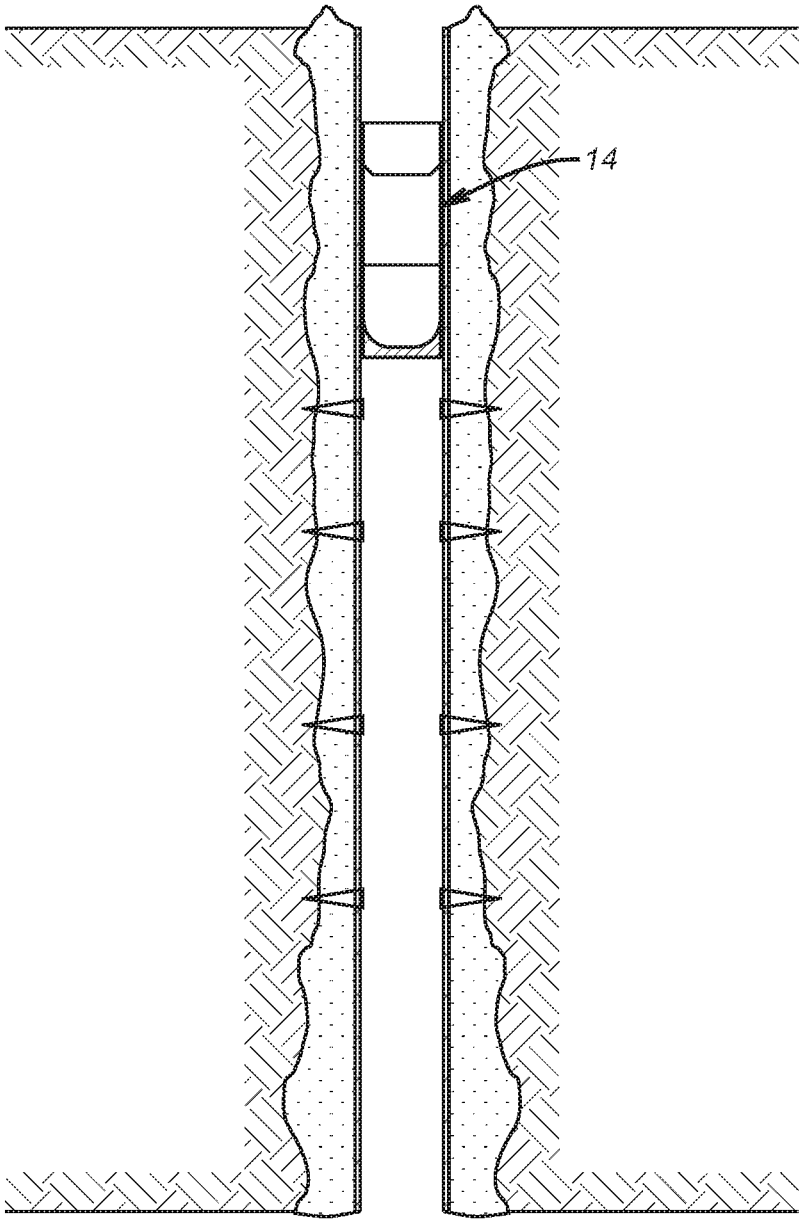
FIG. 2 shows the plug up-well of the perforations after the gun has been removed.
Figure 3:
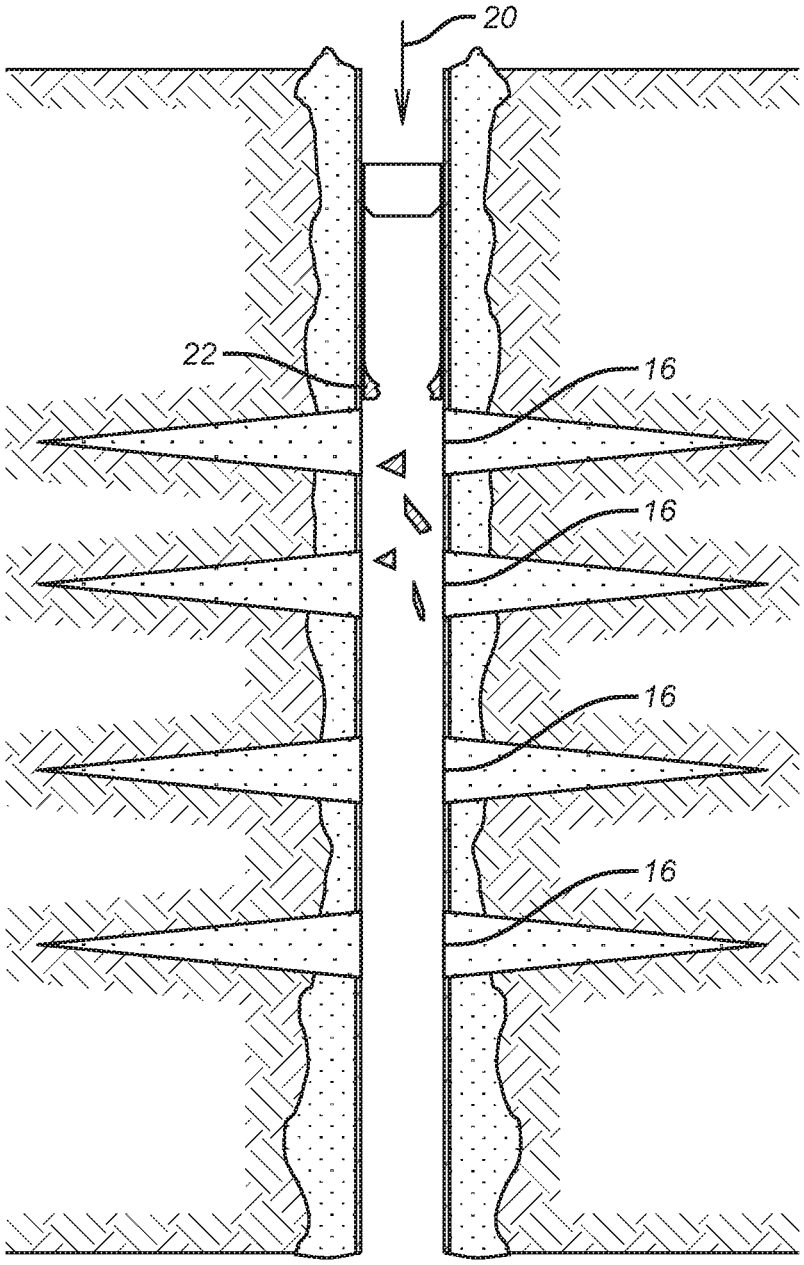
FIG. 3 shows the disc broken with predetermined pressure to provide access to the perforations just made.

Referring to FIG. 1, a wireline 10 delivers a perforating gun assembly 12 along with a plug assembly 14. Multiple perforations 16 extend into the first interval of the formation 18. The plug assembly 14 is raised above the perforations 16 and the plug assembly 14 is set as the gun assembly 12 is released from the plug 14 and removed with wireline 10, as shown in FIG. 2. Pressure is built up from the surface on top of plug assembly 14 until the rupture disc or other breakable member 22 is fragmented at a pressure 20 high enough to treat all the perforations 16 uniformly even if they are heterogeneous as shown in FIG. 3. Preferably that pressure exceeds the highest breakdown stress of the interval. What has occurred in the past with simply initiating pumping into perforations 16 without a pressure buildup away from the perforations 16 temporarily isolated with member 22 is that the perforations with the lowest breakdown stress resistance would take on an outsized portion of the pumped flow, and provide an insufficient reaction block to initiate fracture stimulation in formations with high breakdown stress, such that the formations with high breakdown stress resistance would remain unstimulated or under-stimulated. Instead by ensuring pressure buildup to a desired high predetermined level before any exposure of that pressure to any of the perforations 16, a higher assurance of fracture initiation among heterogeneous perforations 16 with varying breakdown stress is achieved.

Figure 4:
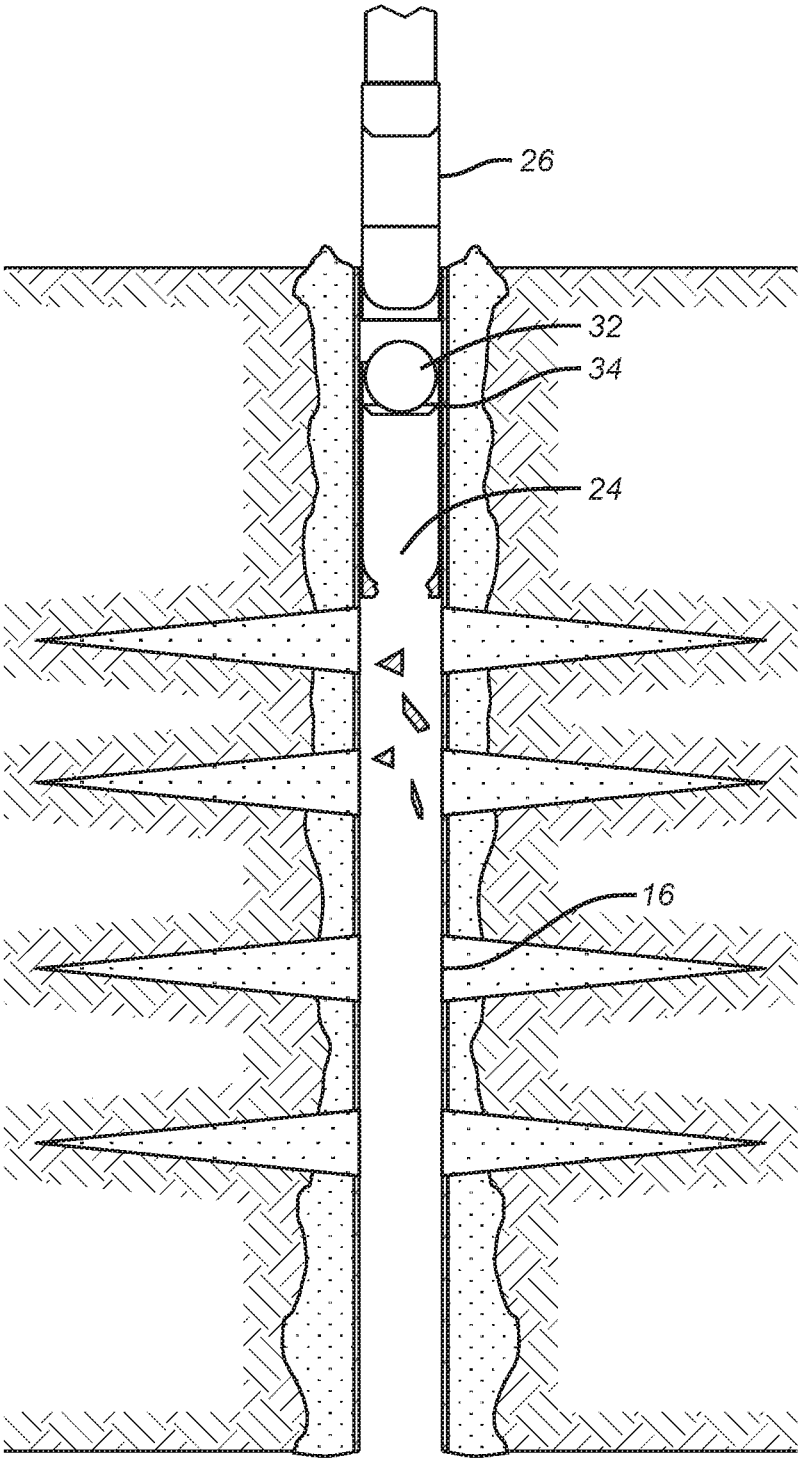
FIG. 4 shows the delivery of a ball to the first plug followed by another plug and perforating gun combination above.
Figure 5:
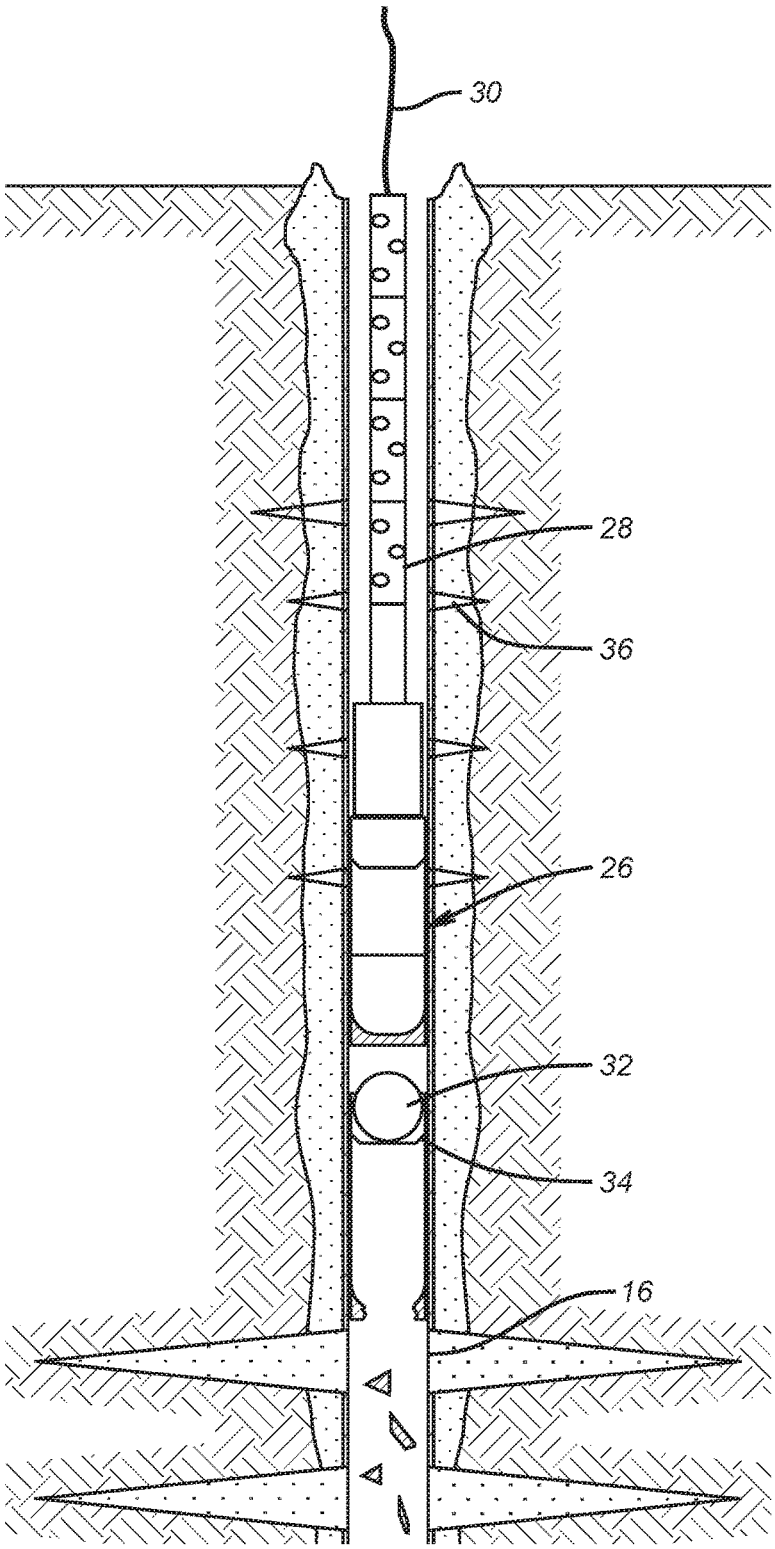
FIG. 5 shows the second gun being fired to make new perforations.
Figure 6:
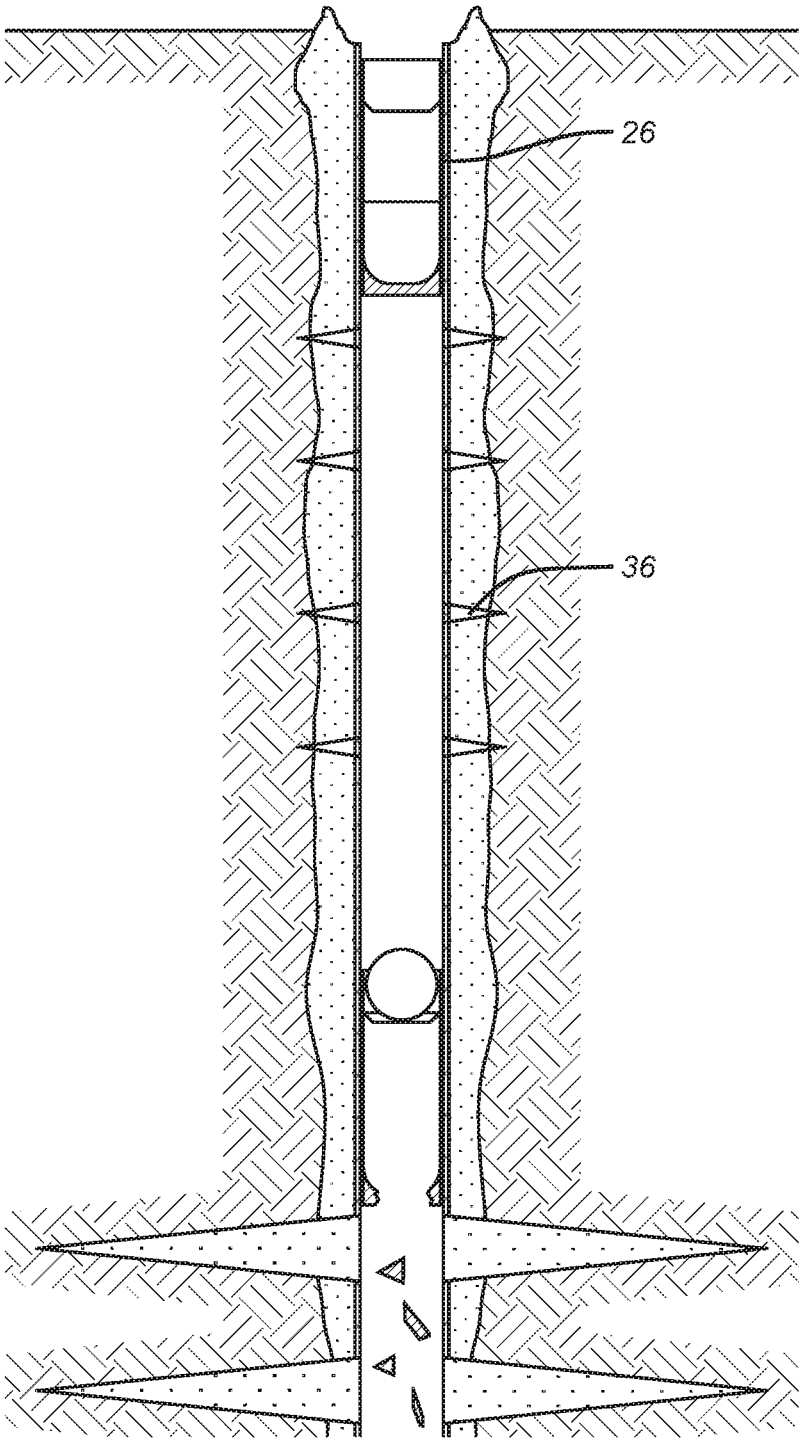
FIG. 6 shows the second plug set above the just made perforations as the second gun is being removed.
Figure 7:
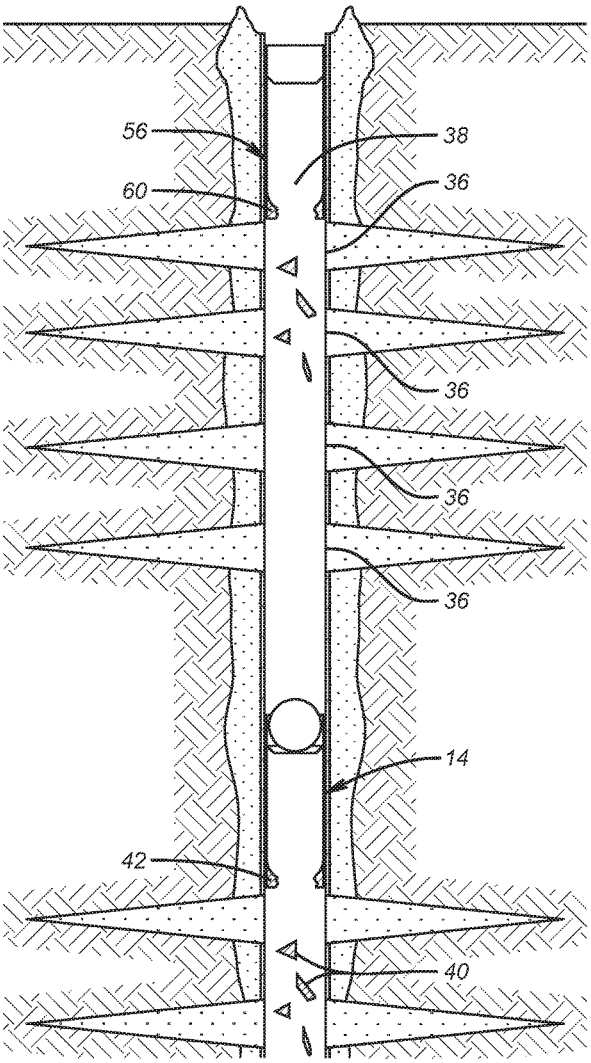
FIG. 7 shows the passage in the second plug being opened with pressure before treatment into the second set of perforations.

Continuing the process as shown in FIG. 4, with the breakable member 22 having been earlier compromised to treat the perforations 16 the now open passage 24 has to be closed and another plug assembly 26 has to be delivered with flow with gun assembly 28 on wireline 30, as better seen in FIG. 5. Ball 32 is placed in the well ahead of plug assembly 26 and gun assembly 28 so that flow can be used to deliver the plug and gun while when ball 32 lands on seat 34 passage 24 is closed and the gun assembly 28 is in position to make perforations 36 when perforations 16 are isolated by seated ball 32 as shown in FIG. 5. As shown in FIG. 6 the gun assembly 28 is raised up to place plug assembly 26 above the perforations 36. Again the pressure is built up against plug assembly 26 after the gun assembly 28 is pulled out of the hole. The same phenomenon happens as before but this time to perforations 36 as passage 38 opens up when fragments 40 are created as the rupture disc or breakable member 42 breaks into pieces 40. Again heterogeneous formations in perforations 36 are treated more evenly due to the pressure buildup on the breakable member 42 before communication with the perforations 36. The process is repeated to handle all the internals in the zone of interest after which the well is put into production in the known manner.

Figure 8:
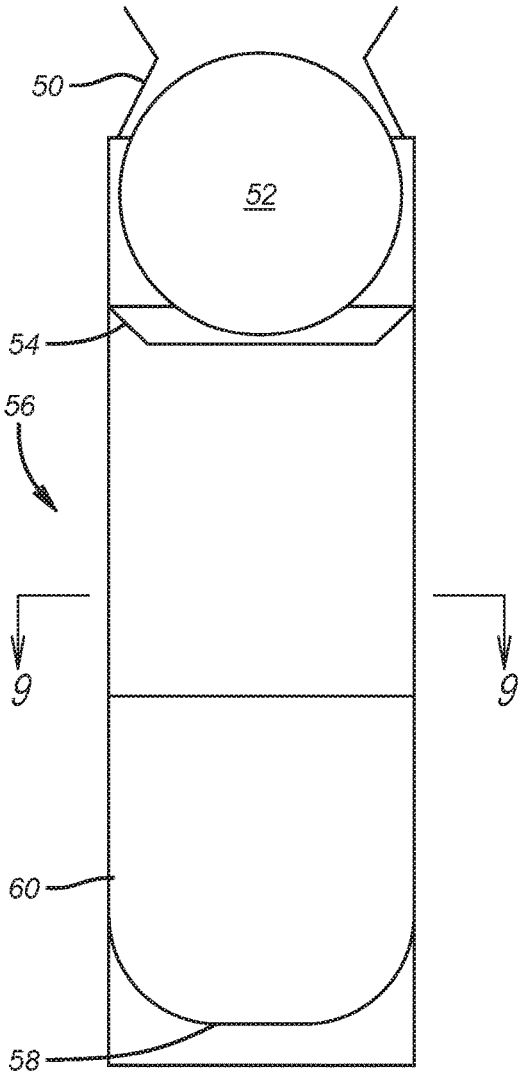
FIG. 8 is a detailed view of a plug assembly with a capture device for a landed ball.
Figure 9:
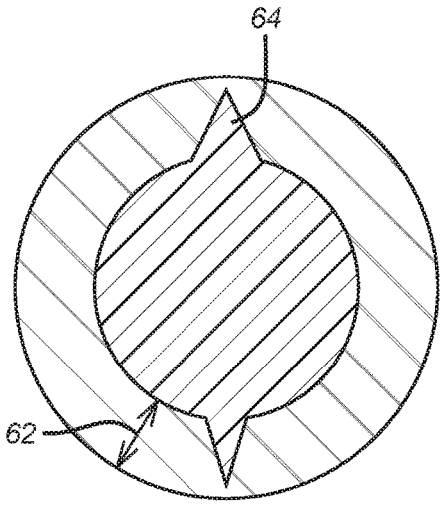
FIG. 9 is an isometric view through line 9-9 of FIG. 8.

FIG. 8 shows some of the additional features of a plug assembly such as 14 or 22. A ball retainer 50 is a flexible device designed to let a ball 52 reach a seat 54 and stay near or on it even though guns above are being removed from the hole. The motion of the gun being pulled out of the hole can create an upward force on the ball 52 commonly referred to as swabbing. Retainer 50 prevents ball 52 from being swabbed off of seat 54. Not shown in FIG. 8 are the customary seal and slip assembly on the plug assembly 56. These are typically set when the plug assembly 56 is released from the gun above so that the gun can be removed. The ends of each plug can be castellated so that in the milling out process the plug assemblies can fall against each other and rotationally lock to make milling them out easier. The downhole end 58 exposed to formation pressure may be dome or disc shaped. The length of the ceramic burst dome 60, or thickness of the burst disc, can be varied to alter the desired pressure at which it will break. Preferably the uphole end of the ceramic burst dome is hollow and exposed to applied pressure. As shown in FIG. 9 the desired break pressure can be varied by varying the wall thickness indicated by arrow 62 or with notches 64.

Those skilled in the art can now appreciate several distinct departures from "plug and perforate" techniques of the past. Foremost is the placement of the plug above the perforations before treatment so that pressure can be built up to a predetermined level before the pressure communicates with perforations to better ensure uniformity of treatment in heterogeneous perforations with different breakdown stress. The guns are fired in each interval before the respective plug assembly is set. The plug assembly initially blocks applied pressure delivered from above at its breakable member and then isolates pressure from above from the already treated perforations when a ball is landed on a seat near an uphole end. The ball is captured to the seat to prevent it from swabbing off the seat when guns are pulled out to allow treatment through the plug when the breakable member is broken. When the plug is initially set it also isolates formation pressure from uphole intervals being perforated. The plugs can be milled out or left in place for the start of production. The plugs can engage each other when milled out to prevent relative rotation.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

The above description is illustrative of the preferred embodiment and many modifications may be made by those skilled in the art without departing from the invention whose scope is to be determined from the literal and equivalent scope of the claims below:

I claim:

1. A subterranean treatment method, comprising:
perforating a first interval at spaced locations;
leaving said spaced locations open to a borehole;
sealing the borehole uphole of perforations, made by said perforating while said perforations remain open to the borehole, with a first plug;
building up borehole pressure against said first plug to a predetermined level while said perforations remain open to the borehole below said first plug; and
opening a passage in said first plug to communicate said built up pressure to said spaced perforations in the interval for the treatment.

2. The method of claim 1, comprising:
providing the interval with formations having differential breakdown stress.

3. The method of claim 1, comprising:
selecting said predetermined pressure level higher than a highest breakdown stress in the interval.

4. The method of claim 1, comprising:
closing a passage in said first plug to isolate the interval already treated.

5. The method of claim 4, comprising:
delivering another plug with a perforating gun above said first plug; and
repeating the steps of perforating, sealing, building up pressure, opening a passage and closing a passage, in at least a second interval uphole of said first interval until a zone of all the intervals is fully treated.

6. The method of claim 5, comprising:
removing said plugs or opening a respective passage in each plug for production from the zone.

7. The method of claim 1, comprising:
providing a breakable member in a passage in said first plug; and
breaking said breakable member with said predetermined pressure.

8. The method of claim 7, comprising:
notching said breakable member or selecting a wall thickness thereof to obtain said predetermined pressure.

9. The method of claim 1, comprising:
running in said first plug with a perforating gun; and
moving said first plug with said perforating gun after said perforating gun is fired.

10. The method of claim 9, comprising:
setting said first plug while releasing from said fired perforating gun; and
removing said perforating gun with a wireline.

11. The method of claim 9, comprising:
performing said running in with flow into the borehole.

12. The method of claim 1, comprising:

initiating or propagating fractures in the interval with said opening a passage.

13. The method of claim 1, comprising:

performing at least one of hydraulic fracturing, stimulation, tracer injection, cleaning, acidizing, steam injection, water flooding, and cementing as said treatment.

14. A subterranean treatment method, comprising:

perforating a first interval;

sealing a borehole uphole of perforations made by said perforating with a first plug;

building up pressure against said first plug to a predetermined level; and opening a passage in said first plug to communicate said built up pressure to perforations in the interval for the treatment;

providing a breakable member in a passage in said first plug; and breaking said breakable member with said predetermined pressure;

providing a ball seat on an uphole end of said first plug; and locating said breakable member downhole of said seat on said first plug.

15. The method of claim 14, comprising:

providing a capture device on said first plug to retain a ball after the ball lands on said seat.

16. A subterranean treatment method, comprising:

perforating a first interval;

sealing a borehole uphole of perforations made by said perforating with a first plug;

building up pressure against said first plug to a predetermined level; and opening a passage in said first plug to communicate said built up pressure to perforations in the interval for the treatment;

closing a passage in said first plug to isolate the interval already treated;

delivering another plug with a perforating gun above said first plug; and repeating the steps of perforating, sealing, building up pressure, opening a passage and closing a passage, in at least a second interval uphole of said first interval until a zone of all the intervals is fully treated;

performing said closing with a ball delivered ahead of said another plug and a perforating gun; and using flow through said first plug to seat said ball on said first plug and to position said another plug and perforating gun.

17. A subterranean treatment method, comprising:

perforating a first interval;

sealing a borehole uphole of perforations made by said perforating with a first plug;

building up pressure against said first plug to a predetermined level;

opening a passage in said first plug to communicate said built up pressure to perforations in the interval for the treatment; and equalizing flow among perforations in locations of differing breakdown stress by said opening a passage.

* * * * *